US009211974B2

(12) United States Patent
Weder et al.

(10) Patent No.: US 9,211,974 B2
(45) Date of Patent: Dec. 15, 2015

(54) CONTAINER ASSEMBLIES HAVING COLLAPSIBLE AND ERECTABLE CONTAINERS CONTAINING A PACKAGING MATERIAL AND METHODS OF PRODUCTION AND USE THEREOF

(75) Inventors: Donald E. Weder, Highland, IL (US); Andrew Weder, Highland, IL (US)

(73) Assignee: Wanda M. Weder & William F. Straeter, Highland, IL (US), not individually but solely as Trustees of The Family Trust U/T/A dated 12/8/1995

( * ) Notice: Subject to any disclaimer, the term of this patent is extended or adjusted under 35 U.S.C. 154(b) by 701 days.

(21) Appl. No.: 13/242,510

(22) Filed: Sep. 23, 2011

(65) Prior Publication Data

US 2012/0240526 A1 Sep. 27, 2012

Related U.S. Application Data

(63) Continuation of application No. 13/015,184, filed on Jan. 27, 2011, now abandoned, which is a continuation of application No. 12/694,942, filed on Jan. 27, 2010, now abandoned, which is a continuation of application (Continued)

(51) Int. Cl.

| | |
|---|---|
| ***B65D 81/02*** | (2006.01) |
| ***B65D 21/08*** | (2006.01) |
| ***B65D 81/05*** | (2006.01) |
| ***B65D 85/52*** | (2006.01) |

(52) U.S. Cl.

CPC ..... *B65D 21/086* (2013.01); *B65D 81/05* (2013.01); *B65D 85/52* (2013.01)

(58) Field of Classification Search

CPC ..... B65B 55/20; B65B 61/22
USPC ..... 53/457; 206/584
See application file for complete search history.

(56) References Cited

U.S. PATENT DOCUMENTS

| | | | |
|---|---|---|---|
| 84,207 | A | 11/1868 | Moore |
| 212,187 | A | 2/1879 | Campbell |
| 524,219 | A | 8/1894 | Schmidt |
| 655,680 | A | 8/1900 | Bachmann |
| 680,186 | A | 8/1901 | Wormer et al. |

(Continued)

FOREIGN PATENT DOCUMENTS

| | | |
|---|---|---|
| AU | 4231978 | 6/1979 |
| BE | 654427 | 1/1965 |

(Continued)

OTHER PUBLICATIONS

Speed Cover Brochure, "The Simple Solution for Those Peak Volume Periods", Highland Supply Corporation, © 1989.

(Continued)

*Primary Examiner* — Stephen F Gerrity
*Assistant Examiner* — Eyamindae Jallow

(57) ABSTRACT

A container assembly is provided which includes a container selectively moveable between an erect condition and a collapsed or substantially flattened condition. A packaging material for support objects is disposed within an object receiving space of the container and secured thereto so that the packaging material remains in the object receiving space of the container when the container is in either the erect condition or the collapsed or substantially flattened condition.

20 Claims, 6 Drawing Sheets

Related U.S. Application Data

No. 12/287,256, filed on Oct. 7, 2008, now abandoned, which is a continuation of application No. 11/481,732, filed on Jul. 6, 2006, now abandoned, which is a continuation-in-part of application No. 13/022,760, filed on Feb. 8, 2011, now abandoned, which is a continuation of application No. 12/577,422, filed on Oct. 12, 2009, now Pat. No. 7,906,190, which is a continuation of application No. 11/063,024, filed on Feb. 22, 2005, now abandoned, which is a continuation-in-part of application No. 10/383,413, filed on Mar. 7, 2003, now abandoned, which is a continuation-in-part of application No. 09/934,301, filed on Aug. 21, 2001, now Pat. No. 6,534,136.

(60) Provisional application No. 60/697,163, filed on Jul. 7, 2005.

(56) References Cited

U.S. PATENT DOCUMENTS

| | | | | | |
|---|---|---|---|---|---|
| 727,728 | A | | 5/1903 | Webb | |
| 732,889 | A | | 7/1903 | Paver | |
| 950,785 | A | | 3/1910 | Pene | |
| 952,258 | A | | 3/1910 | Jenkins | |
| 1,040,652 | A | | 10/1912 | Douglas | |
| 1,044,260 | A | | 11/1912 | Schloss | |
| 1,048,935 | A | | 12/1912 | Brady | |
| 1,063,154 | A | | 5/1913 | Bergen | |
| 1,164,463 | A | | 12/1915 | Cardy | |
| 1,170,570 | A | | 2/1916 | Smith | |
| 1,296,765 | A | | 3/1919 | Christensen | |
| 1,334,186 | A | | 3/1920 | St. Peter | |
| 1,426,916 | A | | 8/1922 | Schropp | |
| 1,446,563 | A | | 2/1923 | Hughes | |
| 1,520,647 | A | | 12/1924 | Hennigian | |
| 1,525,015 | A | | 2/1925 | Weeks | |
| 1,545,771 | A | | 7/1925 | Hout | |
| 1,572,296 | A | | 2/1926 | Kramer et al. | |
| 1,610,652 | A | | 12/1926 | Bouchard | |
| 1,697,751 | A | | 1/1929 | Blake | |
| 1,794,212 | A | | 1/1929 | Snyder | |
| 1,721,143 | A | | 7/1929 | Berkowitz | |
| 1,811,574 | A | | 6/1931 | Barrett | |
| 1,846,584 | A | | 2/1932 | Clark | |
| 1,846,585 | A | | 2/1932 | Clark | |
| 1,863,216 | A | | 6/1932 | Wordingham | |
| 1,978,631 | A | | 10/1934 | Herrlinger | |
| 2,031,153 | A | | 2/1936 | Fessenden | |
| 2,048,123 | A | | 7/1936 | Howard | |
| 2,127,435 | A | | 8/1938 | Snow | |
| RE21,065 | E | | 5/1939 | Copeman | |
| 2,170,147 | A | | 8/1939 | Lane | |
| 2,200,111 | A | | 5/1940 | Bensel | |
| 2,261,594 | A | | 11/1941 | Stevens | |
| 2,271,180 | A | * | 1/1942 | Brugger | 428/119 |
| 2,278,673 | A | | 4/1942 | Savada et al. | |
| 2,302,259 | A | | 11/1942 | Rothfuss | |
| 2,323,287 | A | | 7/1943 | Amberg | |
| 2,355,559 | A | | 8/1944 | Renner | |
| 2,371,985 | A | | 3/1945 | Freiberg | |
| 2,411,328 | A | | 11/1946 | MacNab | |
| 2,470,459 | A | | 5/1949 | Bell | |
| 2,510,120 | A | | 6/1950 | Leander | |
| 2,529,060 | A | | 11/1950 | Trillich | |
| 2,579,036 | A | * | 12/1951 | Edelman | 428/74 |
| 2,621,142 | A | | 12/1952 | Wetherell | |
| 2,648,487 | A | | 8/1953 | Linda | |
| 2,688,354 | A | | 9/1954 | Berger | |
| 2,688,914 | A | | 9/1954 | Eckler | |
| 2,774,187 | A | | 12/1956 | Smithers | |
| 2,822,287 | A | | 2/1958 | Avery | |
| 2,828,755 | A | | 4/1958 | Stockman | |
| 2,846,060 | A | | 8/1958 | Yount | |
| 2,850,842 | A | | 9/1958 | Eubank, Jr. | |
| 2,880,902 | A | | 4/1959 | Owsen | |
| 2,883,262 | A | | 4/1959 | Borin | |
| 2,893,167 | A | | 7/1959 | Davidson | |
| 2,966,293 | A | | 12/1960 | Goldsholl | |
| 2,989,828 | A | | 6/1961 | Warp | |
| 3,003,681 | A | | 10/1961 | Orsini | |
| 3,022,605 | A | | 2/1962 | Reynolds | |
| 3,047,136 | A | | 7/1962 | Arthur | |
| 3,047,183 | A | | 7/1962 | Papa | |
| 3,074,543 | A | | 1/1963 | Stanley | |
| 3,080,680 | A | | 3/1963 | Reynolds et al. | |
| 3,094,810 | A | | 6/1963 | Kalpin | |
| 3,121,647 | A | | 2/1964 | Harris et al. | |
| 3,130,113 | A | | 4/1964 | Silman | |
| 3,172,796 | A | | 3/1965 | Gülker | |
| 3,271,922 | A | | 9/1966 | Wallerstein et al. | |
| 3,293,100 | A | | 12/1966 | Questel | |
| 3,316,675 | A | | 5/1967 | Cartwright, Jr. | |
| 3,322,325 | A | | 5/1967 | Bush | |
| 3,337,086 | A | | 8/1967 | Jenks | |
| 3,357,152 | A | | 12/1967 | Geigel | |
| 3,376,666 | A | | 4/1968 | Leonard | |
| 3,380,646 | A | | 4/1968 | Doyen et al. | |
| 3,405,863 | A | | 10/1968 | Kugler | |
| 3,431,706 | A | | 3/1969 | Stuck | |
| 3,431,923 | A | | 3/1969 | Klepac | |
| 3,481,455 | A | * | 12/1969 | Graham et al. | 206/523 |
| 3,508,372 | A | | 4/1970 | Wallerstein et al. | |
| 3,510,054 | A | | 5/1970 | Sanni et al. | |
| 3,512,700 | A | | 5/1970 | Evans et al. | |
| 3,526,333 | A | | 9/1970 | Formo et al. | |
| 3,546,055 | A | * | 12/1970 | Spertus | 428/52 |
| 3,550,318 | A | | 12/1970 | Remke et al. | |
| 3,552,059 | A | | 1/1971 | Moore | |
| 3,554,434 | A | | 1/1971 | Anderson | |
| 3,556,389 | A | | 1/1971 | Gregoire | |
| 3,557,516 | A | | 1/1971 | Brandt | |
| 3,559,847 | A | | 2/1971 | Goodrich | |
| 3,565,325 | A | | 2/1971 | Pugsley | |
| 3,620,366 | A | | 11/1971 | Parkinson | |
| 3,650,877 | A | * | 3/1972 | Johnson | 428/222 |
| 3,681,105 | A | | 8/1972 | Milutin et al. | |
| 3,727,785 | A | | 4/1973 | Lutz | |
| 3,740,092 | A | | 6/1973 | Page | |
| 3,743,172 | A | * | 7/1973 | Ackley et al. | 383/104 |
| 3,767,104 | A | | 10/1973 | Bachman et al. | |
| 3,793,799 | A | | 2/1974 | Howe et al. | |
| 3,804,322 | A | | 4/1974 | Ericson | |
| 3,869,828 | A | | 3/1975 | Matsumoto | |
| 3,888,443 | A | | 6/1975 | Flanigen | |
| 3,902,541 | A | | 9/1975 | Wardwell | |
| 3,921,897 | A | | 11/1975 | Noyes et al. | |
| 3,949,933 | A | | 4/1976 | Giambrone et al. | |
| 3,962,503 | A | | 6/1976 | Crawford | |
| 3,986,749 | A | | 10/1976 | Hull et al. | |
| 3,999,653 | A | * | 12/1976 | Haigh et al. | 206/584 |
| 4,043,077 | A | | 8/1977 | Stonehocker | |
| 4,054,697 | A | | 10/1977 | Reed et al. | |
| 4,091,925 | A | | 5/1978 | Griffo et al. | |
| 4,113,100 | A | | 9/1978 | Soja et al. | |
| 4,118,890 | A | | 10/1978 | Shore | |
| 4,149,339 | A | | 4/1979 | Hall et al. | |
| 4,162,696 | A | * | 7/1979 | Sprung | 206/316.2 |
| 4,170,618 | A | | 10/1979 | Adams | |
| 4,171,145 | A | | 10/1979 | Pearson, Sr. | |
| 4,189,868 | A | | 2/1980 | Tymchuck et al. | |
| 4,216,620 | A | | 8/1980 | Weder et al. | |
| 4,248,347 | A | | 2/1981 | Trimbee | |
| D259,333 | S | | 5/1981 | Charbonneau | |
| 4,265,049 | A | | 5/1981 | Gorewitz | |
| 4,279,933 | A | | 7/1981 | Austin et al. | |
| 4,280,314 | A | | 7/1981 | Stuck | |
| 4,292,266 | A | | 9/1981 | Weder et al. | |
| 4,297,811 | A | | 11/1981 | Weder | |
| 4,333,267 | A | | 6/1982 | Witte | |
| 4,334,359 | A | | 6/1982 | Kump | |
| 4,347,686 | A | | 9/1982 | Wood | |
| 4,380,564 | A | | 4/1983 | Cancio et al. | |

(56) References Cited

U.S. PATENT DOCUMENTS 4,400,910 A 8/1983 Koudstall et al.
4,413,725 A 11/1983 Bruno et al.
4,453,665 A 6/1984 Roccaforte et al.
4,508,223 A 4/1985 Catrambone
D279,279 S 6/1985 Wagner
4,546,875 A 10/1985 Zweber
4,619,426 A 10/1986 Drueck, Jr.
4,621,733 A 11/1986 Harris
4,640,079 A 2/1987 Stuck
4,674,972 A 6/1987 Wagner
4,678,095 A 7/1987 Barnett et al.
4,692,111 A 9/1987 Wagner
4,717,262 A 1/1988 Roen et al.
4,733,521 A 3/1988 Weder et al.
4,765,464 A 8/1988 Ristvedt
4,771,573 A 9/1988 Stengel
4,773,182 A 9/1988 Weder et al.
4,773,622 A 9/1988 Herlin
4,795,648 A 1/1989 Capy et al.
4,801,014 A 1/1989 Meadows
4,810,109 A 3/1989 Castel
4,835,834 A 6/1989 Weder
D301,991 S 7/1989 Van Sant
4,867,220 A 9/1989 Matsumoto et al.
D304,317 S 10/1989 Wagner
4,900,390 A 2/1990 Colten et al.
4,907,380 A 3/1990 Jannin
4,941,572 A 7/1990 Harris
4,946,290 A 8/1990 Matyja
4,969,568 A 11/1990 Yoshida
4,980,209 A 12/1990 Hill
4,989,396 A 2/1991 Weder et al.
D315,700 S 3/1991 Stephens
5,005,760 A 4/1991 van den Hoogen
5,073,161 A 12/1991 Weder et al.
5,074,675 A 12/1991 Osgood
5,076,011 A 12/1991 Stehouwer
5,105,599 A 4/1992 Weder
5,111,638 A 5/1992 Weder
5,117,584 A 6/1992 Ottenwalder
5,120,382 A 6/1992 Weder
5,125,564 A 6/1992 Capy
5,134,013 A * 7/1992 Parker ..... 428/182
5,152,100 A 10/1992 Weder et al.
5,181,364 A 1/1993 Weder
D335,105 S 4/1993 Ottenwalder et al.
5,199,242 A 4/1993 Weder et al.
5,205,108 A 4/1993 Weder et al.
5,228,234 A 7/1993 de Klerk et al.
5,235,782 A 8/1993 Landau
5,238,288 A 8/1993 Chandler
5,239,775 A 8/1993 Landau
5,244,093 A 9/1993 Carmichael et al.
5,249,407 A 10/1993 Stuck
5,259,106 A 11/1993 Weder et al.
5,279,456 A 1/1994 Bernstein
5,307,606 A 5/1994 Weder
5,315,785 A 5/1994 Avôt et al.
5,345,961 A 9/1994 Yercha et al.
5,350,240 A 9/1994 Billman et al.
5,350,473 A 9/1994 Weder et al.
5,353,575 A 10/1994 Stepanek
5,361,482 A 11/1994 Weder et al.
5,385,377 A 1/1995 Girard
5,388,695 A 2/1995 Gilbert
5,392,983 A 2/1995 Clark-Bolling et al.
5,428,939 A 7/1995 Weder et al.
5,443,670 A 8/1995 Landau
D362,829 S 10/1995 Wagner
5,493,809 A 2/1996 Weder et al.
D368,025 S 3/1996 Sekerak et al.
5,496,251 A 3/1996 Cheng
5,496,252 A 3/1996 Gilbert
5,518,167 A 5/1996 Capy et al.
5,522,639 A 6/1996 Jaime
5,526,932 A 6/1996 Weder
5,551,570 A 9/1996 Shaffer et al.
5,568,867 A * 10/1996 Lencoski ..... 206/584
5,572,826 A 11/1996 Weder
5,572,849 A 11/1996 Weder et al.
5,572,851 A 11/1996 Weder
5,575,107 A 11/1996 Doerr
5,575,133 A 11/1996 Weder et al.
5,580,625 A 12/1996 Capy et al.
5,590,783 A 1/1997 Capy et al.
5,617,703 A 4/1997 Weder
5,624,320 A 4/1997 Martinez
5,625,979 A 5/1997 Weder
5,643,647 A * 7/1997 Wischusen, III ..... 428/36.9
5,647,168 A 7/1997 Gilbert
5,647,193 A 7/1997 Weder et al.
5,706,605 A 1/1998 Alcazar
5,715,944 A 2/1998 Windisch
5,735,103 A 4/1998 Weder
5,752,649 A 5/1998 Weder
5,753,327 A 5/1998 Weder et al.
5,758,472 A 6/1998 Weder
5,813,194 A 9/1998 Weder
D399,787 S 10/1998 Wagner
D399,788 S 10/1998 Wagner
5,823,840 A 10/1998 Powers
5,845,957 A 12/1998 Hurst
D404,684 S 1/1999 Shea
5,878,945 A 3/1999 Weder
5,897,926 A * 4/1999 Mikulas ..... 428/17
D409,057 S 5/1999 Wagner
5,906,280 A 5/1999 Weder
5,908,111 A 6/1999 Purdy
5,924,241 A 7/1999 Hodge
5,941,020 A 8/1999 Weder
D413,547 S 9/1999 Wagner
5,953,853 A 9/1999 Kim
5,966,866 A 10/1999 Ferguson
5,974,730 A 11/1999 Chien
5,992,637 A 11/1999 Weder
D419,436 S 1/2000 Celtorius et al.
6,009,687 A 1/2000 Weder
6,047,524 A 4/2000 Weder
6,048,592 A * 4/2000 Rolf ..... 428/17
D424,972 S 5/2000 Ferguson
6,071,445 A 6/2000 Wagner
D428,827 S 8/2000 Wagner
6,098,336 A 8/2000 Ferguson
D431,495 S 10/2000 Wagner
6,129,208 A 10/2000 Ferguson
6,129,209 A 10/2000 Tchira
6,141,906 A 11/2000 Weder
D435,481 S 12/2000 Wagner
6,182,395 B1 2/2001 Weder
6,183,590 B1 2/2001 Weder
6,209,611 B1 4/2001 Johnson
6,230,441 B1 5/2001 Weder et al.
6,237,819 B1 * 5/2001 Ramirez ..... 223/46
D448,130 S 9/2001 Wagner
6,286,255 B1 9/2001 Weder et al.
6,286,256 B1 9/2001 Weder
6,298,601 B1 10/2001 Weder et al.
6,345,467 B1 2/2002 Weder
6,347,481 B1 2/2002 Weder
6,385,906 B2 5/2002 Weder
6,397,560 B1 6/2002 Weder
6,427,381 B1 8/2002 Weder
6,523,684 B1 2/2003 Daniels, Jr.
6,534,136 B2 3/2003 Weder
6,547,263 B1 4/2003 McGeorge et al.
6,607,089 B2 8/2003 Ferguson
6,658,792 B2 12/2003 Weder
6,695,202 B2 2/2004 Miess
6,711,852 B2 3/2004 Weder et al.
8,123,666 B2 * 2/2012 Govig ..... 493/121
8,348,822 B1 * 1/2013 Govig ..... 493/56
2001/0055656 A1 * 12/2001 Weder ..... 428/35.2
2002/0078506 A1 6/2002 Sloot
2002/0112401 A1 8/2002 Weder et al.

(56) References Cited

U.S. PATENT DOCUMENTS

| | | | | |
|---|---|---|---|---|
| 2002/0185407 | A1* | 12/2002 | Kronenberger | 206/584 |
| 2002/0195450 | A1 | 12/2002 | Ferguson | |
| 2003/0188485 | A1 | 10/2003 | Weder | |
| 2004/0028852 | A1 | 2/2004 | Weder | |
| 2004/0108243 | A1* | 6/2004 | Jeannin | 206/584 |
| 2005/0221031 | A1 | 10/2005 | Weder | |
| 2013/0102219 | A1* | 4/2013 | Laiken et al. | 446/73 |

FOREIGN PATENT DOCUMENTS

| | | | |
|---|---|---|---|
| CH | 560532 | | 4/1975 |
| DE | 15550 | | 6/1900 |
| DE | 345464 | | 12/1921 |
| DE | 513971 | | 11/1930 |
| DE | 1166692 | | 3/1964 |
| DE | 1962947 | | 6/1971 |
| DE | 2060812 | | 11/1971 |
| DE | 2748626 | | 5/1979 |
| DE | 3445799 | | 6/1986 |
| DE | 3911847 | | 10/1990 |
| DE | 4009852 | | 9/1991 |
| DK | 1204647 | | 9/1970 |
| EP | 0050990 | | 5/1982 |
| EP | 0378072 | | 7/1990 |
| EP | 0791543 | | 8/1997 |
| EP | 0873941 | | 10/1998 |
| FR | 1376047 | | 9/1964 |
| FR | 2036163 | | 12/1970 |
| FR | 2137325 | | 12/1972 |
| FR | 2272914 | | 12/1975 |
| FR | 2489126 | | 3/1982 |
| FR | 2567068 | | 7/1984 |
| FR | 2570677 | | 9/1984 |
| FR | 2610604 | | 8/1988 |
| FR | 2603159 | | 3/1989 |
| FR | 2619698 | | 3/1989 |
| GB | 5605 | | 0/1885 |
| GB | 2043595 | A | 10/1980 |
| GB | 2056410 | | 3/1981 |
| GB | 2074542 | | 11/1981 |
| GB | 2121383 | A | 12/1983 |
| GB | 2128083 | | 4/1984 |
| GB | 2157552 | A | 10/1985 |
| GB | 2203127 | | 10/1988 |
| GB | 2212136 | | 7/1989 |
| GB | 2221447 | A | 2/1990 |
| GB | 2252708 | A | 8/1992 |
| IT | 224507 | | 4/1996 |
| JP | 3-200537 | | 3/1991 |
| JP | 542958 | | 2/1993 |
| JP | 6127555 | | 5/1994 |
| JP | 8-19334 | | 1/1996 |
| JP | 8-2518 | | 8/1996 |
| JP | 10129770 | A | 5/1998 |
| JP | 11009102 | A | 1/1999 |
| NL | 8301709 | | 12/1984 |
| NL | 1000658 | | 1/1996 |
| WO | WO 87/02327 | | 4/1987 |
| WO | 9315979 | | 8/1993 |
| WO | 9712819 | | 4/1997 |

OTHER PUBLICATIONS

"Speed Sheets and Speed Rolls" Brochure, Highland Supply Corporation, © 1990.
"Color Them Happy with Highlander Products" ©1992.
"Costa Keeps the Christmas Spirit", Supermarket Floral, Sep. 15, 1992.
"Super Seller", Supermarket Floral, Sep. 15, 1992.
"Halloween", Link Magazine, Sep. 1992.
"Now More Than Ever", Supermarket Floral, Sep. 15, 1992.
Le Plant Sac Advertisement, published prior to Sep. 26, 1987.
"A World of Cut Flower and Pot Plant Packaging" Brochure, Klerk's Plastic Products Manufacturing, Inc., published prior to Mar. 31, 1994, 6 pages.
Chantler & Chantler brochure showing Zipper Sleeve™ and Florasheet®, published prior to Mar. 31, 1994, 2 pages.
"Stand Alone Plastic Bagmaking" brochure, AMI, Atlanta, GA, Feb. 15, 1996, 2 pages.
"Foil Jackets" brochure, Custom Medallion, Inc., Dec. 1996, 2 pages.
"Derwent Abstract" of FR 2610604A. It is noted that the abstract is an incorrect English translation of the contents of the French patent. The French patent does not enable or disclose adhesively attaching the covering to the container. 1988.
"Silver Linings" Brochure, Affinity Diversified Industries, Inc., 1986. The Silver Linings brochure shows a floral sleeve with a closed bottom. The brochure shows , in one embodiment, a vase with flowers inside a "cut flower" sleeve with the sleeve tied with a ribbon about the neck of the vase.
"Special Occasion Printed Highlophane Bags" Brochure, Highland Supply Corporation, 1990, 2 pages.
"Creative Packaging" Brochure, John Henry Company, Sep. 1992.
"Make Highlander Your Headquarters" Brochure, Highland Supply Corporation, 1991.
New Leaf Brochure by Helgor Marketing Inc., Calgary, Canada; 2 pages.
Stainless Steel Steam Basket Produced by Reform-Kocheinsatz aus Edeistahl-Rostfrei.
Collapsible Easter Basket from Goffa Int'l Corp. L.I.C., NY 11101.
Hat with Labels "Crush and Pack! It Springs Back!" and "Cov-ver Your World". Purchased from The Village Hat Shop, 3821 4th Avenue, San Diego, CA 92103.
Collapsible Easter Treat Bag, Oriental Trading Company, Inc.
Felt Stovepipe Hats, Oriental Trading Company, Inc.
Plush Halloween Character Baskets, Oriental Trading Company, Inc.
Collapsable Trick or Treat Bag, Oriental Trading Company, Inc.
Metallic Star-Shaped Boxes, Oriental Trading Company, Inc.
Packaging for Rubbermaid® Collapsible Container, UPC #71691 23913, © 2005 Rubbermaid®, Inc., Huntersville, NC, 4 pgs.

* cited by examiner

CONTAINER ASSEMBLIES HAVING COLLAPSIBLE AND ERECTABLE CONTAINERS CONTAINING A PACKAGING MATERIAL AND METHODS OF PRODUCTION AND USE THEREOF

CROSS REFERENCE TO RELATED APPLICATIONS

This application is a continuation of U.S. Ser. No. 13/015,184, filed Jan. 27, 2011, now abandoned; which is a continuation of U.S. Ser. No. 12/694,942, filed Jan. 27, 2010, now abandoned; which is a continuation of U.S. Ser. No. 12/287,256, filed Oct. 7, 2008, now abandoned; which is a continuation of U.S. Ser. No. 11/481,732, filed Jul. 6, 2006, now abandoned; which claims benefit under 35 U.S.C. 119(e) of provisional application U.S. Ser. No. 60/697,163, filed Jul. 7, 2005.

This application is also a continuation-in-part of U.S. Ser. No. 13/022,760, filed Feb. 8, 2011 now abandoned; which is a continuation of U.S. Ser. No. 12/577,422, filed Oct. 12, 2009 now U.S. Pat. No. 7,906,190; which is a continuation of U.S. Ser. No. 11/063,024, filed Feb. 22, 2005, now abandoned; which is a continuation-in-part of U.S. Ser. No. 10/383,413, filed on Mar. 7, 2003, now abandoned; which is a continuation-in-part of U.S. Ser. No. 09/934,301, filed Aug. 21, 2001, now U.S. Pat. No. 6,534,136.

The entire contents of each of the above-referenced patents and patent applications are hereby expressly incorporated herein by reference.

STATEMENT REGARDING FEDERALLY SPONSORED RESEARCH AND DEVELOPMENT

Not applicable.

BACKGROUND OF INVENTION

1. Field of Invention

The presently disclosed and claimed inventive concept(s) relates generally to a container assembly, and more particularly to a container assembly which includes containers selectively movable between a collapsed condition and/or erect condition wherein the containers contain a packaging material. In one aspect, the presently disclosed and claimed inventive concept(s) relates to a container assembly having collapsible and/or erectable containers containing a packaging material formed of a plurality of individual strips, strands or units of material which are bondingly connected to a flexible substrate to form a cohesive cushioning unit. In yet another aspect, the presently disclosed and claimed inventive concept(s) relates to a container assembly having a collapsible and/or erectable floral container and a flexible, inflatable substrate having a plurality of individual strips, strands or units of decorative material bondingly connected to the flexible inflatable substrate to form a cohesive cushioning unit.

2. Brief Description of Related Art

In the process of shipping an article from one location to another, the article may be placed in a container along with a protective packaging material to fill voids about the article and to cushion the article during the shipping process. One such common protective packaging material includes a plurality of polymeric foam peanut-shaped members which are commonly known in the art as "Styrofoam Peanuts." An advantage of using the Styrofoam Peanuts is the ease in which they may be disposed about an article positioned in a container by simply pouring the Styrofoam Peanuts into the container.

While Styrofoam Peanuts have been widely accepted in the packaging industry, they are not without disadvantages. For example, the light weight and flowability of the Styrofoam Peanuts result in heavier articles gravitating through the Styrofoam Peanuts to the bottom of the container during shipping, and the receiver of the package is left with the problem of disposing of the Styrofoam Peanuts once the package has arrived at its destination and the article removed there from.

Strips of sheet material formed into tufts have also been used for many years as a packaging material. More specifically, material known as decorative grass has been used in fruit baskets, Easter baskets, picnic baskets, and for other packaging and decorative purposes.

Flowers and other plants have long been grown and displayed in pots, commonly referred to as "flower pots." Flower pots are generally constructed of natural, earthen materials, such as clay which is in turn glazed and fired to produce a hardened non-flexible ceramic structure. Flower pots have also been constructed of plastic materials which are colored or painted to have the appearance of an earthen material. While clay or ceramic flower pots are both aesthetically pleasing and effectively serve the purpose of containing plant material in a growing medium, inefficiencies are nevertheless experienced in shipping and storing such containers due to their bulkiness and susceptibility to breakage.

To this end, a need exists for a container assembly that can be shipped and stored in a substantially flattened or collapsed condition and readily erected into a container that can protect fragile items, such as figurines, ceramic objects and the like during shipping and/or storage. It is to such containers and flexible packaging materials that the present invention is directed.

DETAILED DESCRIPTION OF THE INVENTIVE CONCEPT(S)

The presently disclosed and claimed inventive concept(s) relates to a container assembly which includes a collapsible and/or erectable, shape-sustaining container and a packaging material disposed in the container for supporting articles. In one aspect, the presently disclosed and claimed inventive concept(s) relates to a container assembly wherein a packaging material for supporting floral groupings, eggs and other fragile articles is disposed in a connection to the collapsible and/or erectable container.

It is to be understood that while the terms "collapsible" or "erectable" may be used herein with respect to a particular embodiment of a shape sustaining container, one of ordinary skill in the art would easily understand and could easily adapt the containers described herein to be "collapsible," "erectable," or both, and therefore such terms should be understood as being used interchangeably herein. As such, collapsible shape sustaining containers, erectable shape sustaining containers, and collapsible and erectable shape sustaining containers are all fully within the scope of the presently disclosed and claimed inventive concept(s), and the use of the term "collapsible" should be understood to also include containers that are "erectable," while use of the term "erectable" should also be understood to include containers that are "collapsible."

Figure 1:
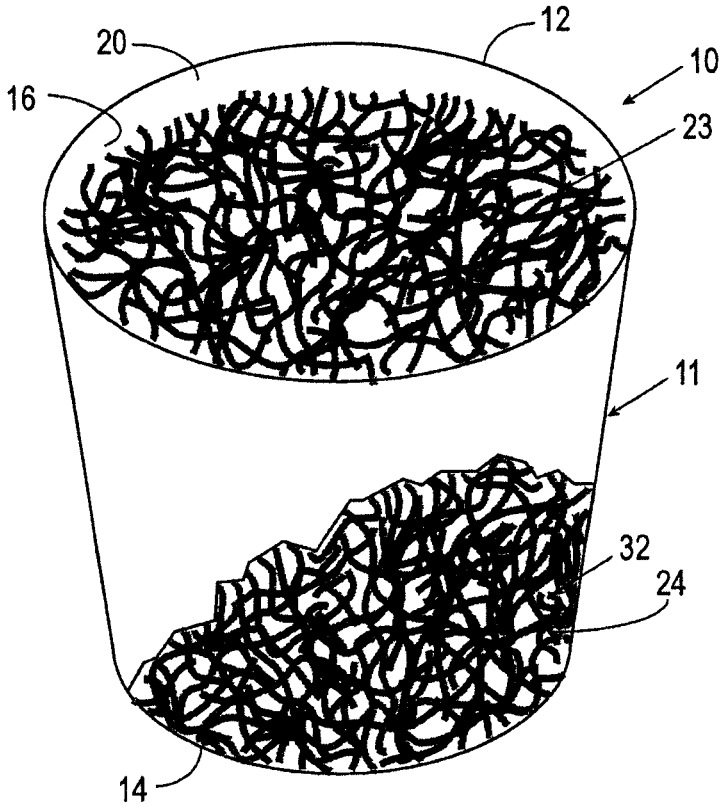
FIG. 1 is a partially cut-away, perspective view of a container assembly of the presently disclosed and claimed inventive concept(s), the container assembly having a container containing a packaging material formed of a plurality of the strips or strands of material, the container being shown in an erect condition.
Figure 2:
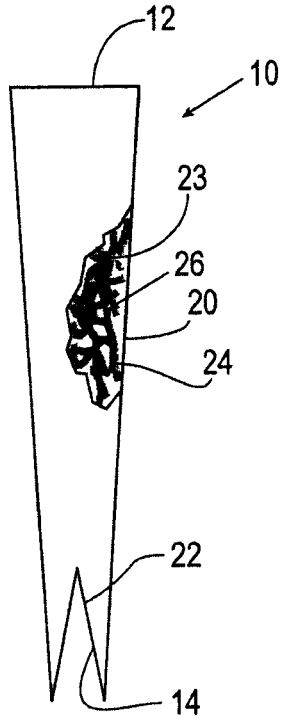
FIG. 2 is a partially cut-away, perspective view of the container assembly of FIG. 1 in a collapsed condition.

Referring now to FIG. 1, shown therein is a container assembly 10 constructed in accordance with the presently disclosed and claimed inventive concept(s). The container assembly 10 includes a collapsible and/or erectable container 11 which is disposed in an erect condition. The container 11 includes an open upper end 12, a closed lower end or bottom 14, an inner surface 16, an outer surface 18, and an object receiving space 20. A packaging material 23 is disposed within the object receiving space 20 of the container 11 for cushioning objects supported in the object receiving space 20 of the container 11. At least a portion of the packaging material 23 is connected to at least one of the inner surface 16 and the closed lower end 14 of the container 11 so that the packaging material 23 remains substantially within the object receiving space 20 of the container 11 where the container 11 is moved to the collapsed condition (FIG. 2). As will be more fully described herein after, the packaging material 23 can be a tuft of material, a flexible, inflatable substrate assembly, a flexible substrate assembly or combinations thereof.

To enhance the movement of the container 10 between the erect condition (FIG. 1) and the collapsed or flattened condition (FIG. 2), the container 11 may be provided with a gusset 22 in the closed lower end 14 thereof. The above embodiment of the collapsible and/or erectable container 10, as well as other embodiments of such containers, is disclosed in U.S. patent application Ser. No. 11/103,405 filed Mar. 11, 2005, the entire contents of such application being hereby specifically incorporated herein by reference.

Figure 3:
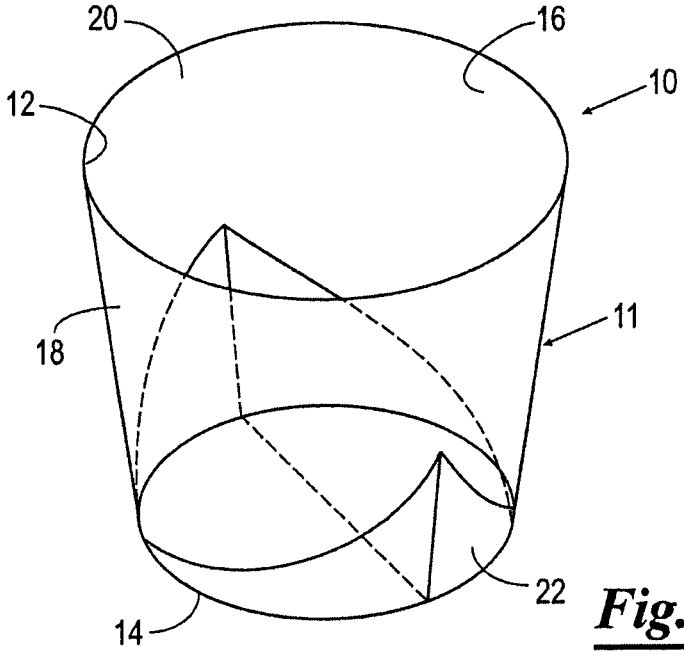
FIG. 3 is a perspective view of a container of the container assembly of the presently disclosed and claimed inventive concept(s), the container selectively movable between an erect condition and a collapsed condition, the container being illustrated in the erect condition.
Figure 4:
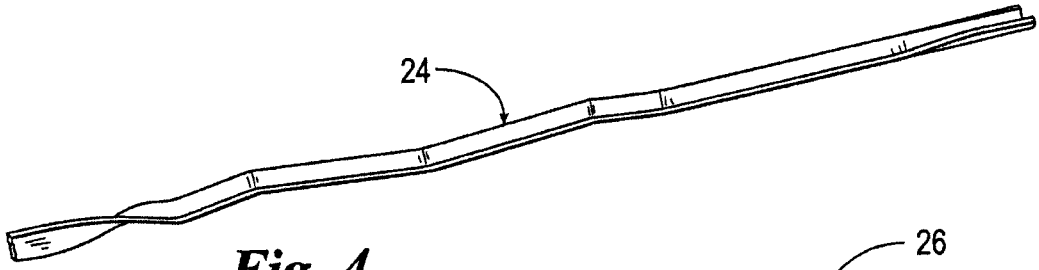
FIG. 4 is a perspective view of a strand or strip of material utilized to construct a packaging material to form a cohesive cushioning unit for the container of FIG. 1.
Figure 8:
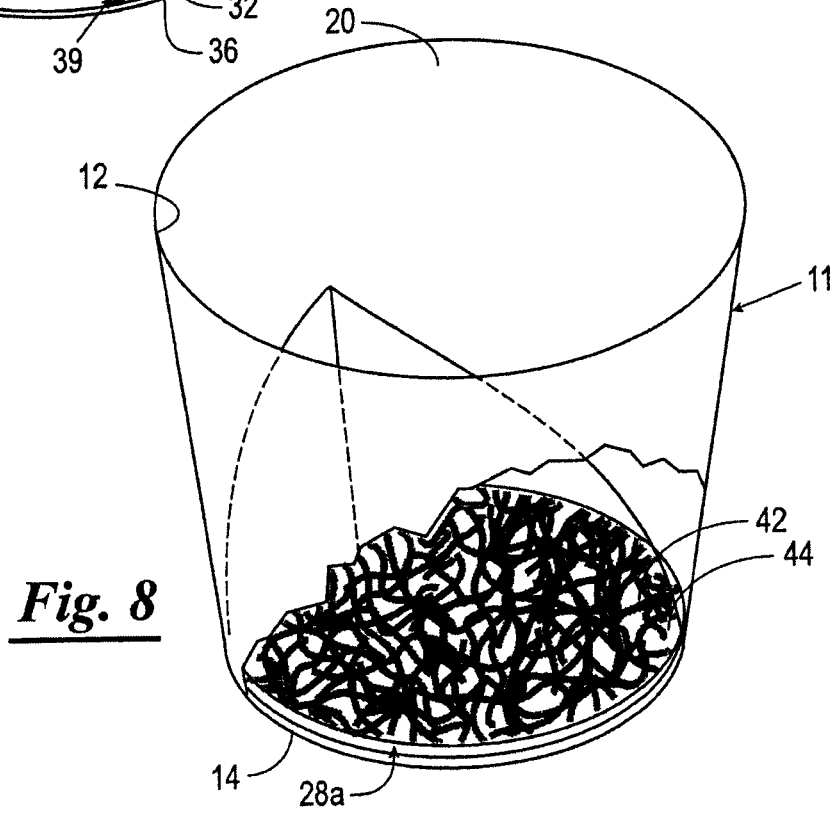
FIG. 8 is a partially cut-away, perspective view of a container assembly of the presently disclosed and claimed inventive concept(s) wherein a container is shown in an erect condition and a flexible substrate is disposed therein.
Figure 9:
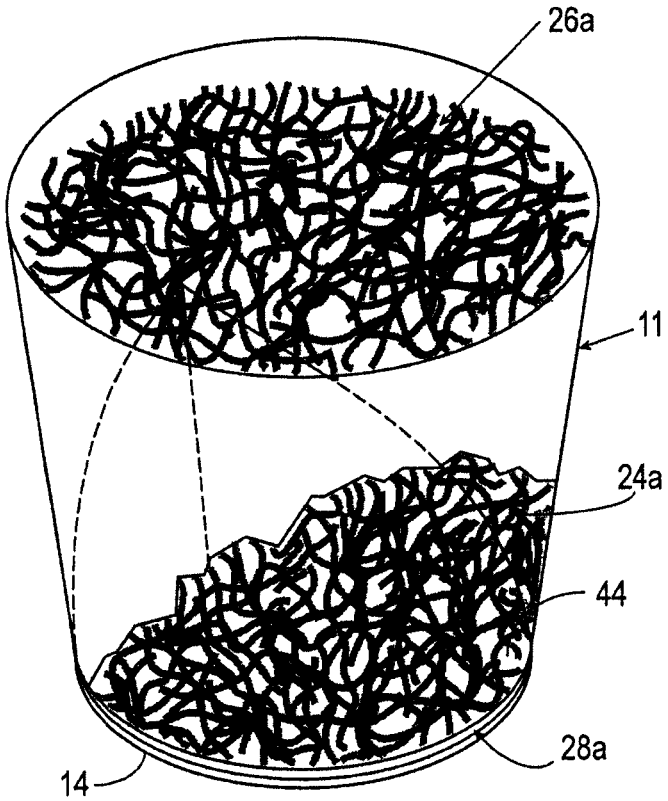
FIG. 9 is a partially cut-away, perspective view of a container assembly of the presently disclosed and claimed inventive concept(s) wherein a tuft of material formed a plurality of the strips or strands of the material of FIG. 4 is disposed within an object receiving space of a container and supported on a flexible substrate, the flexible substrate being disposed on the closed lower end of the container.

Referring now to FIG. 3, shown therein is one strip or strand of material 24 employed to form a tuft 26 of material disposed within the object receiving space 20 of the container 11 (FIGS. 1 and 2). The tuft of the material 26, which is made up of a plurality of individual strips or strands 24 and which may be intertwined with one another, can be supported within the object receiving space 20 of the container 11 for cushioning objects disposed within the object receiving space 20 of the container 10 as will be described in more detail herein after. The tuft of material 26 can be connected to at least a portion of the inner surface 16 of the container 11 so that the tuft of material 26 extends from the closed lower end 14 of the container 10 toward the open upper end 12 thereof; or the tuft of material 26 can be connected to a flexible, inflatable substrate assembly 28 (FIG. 5) supported within the object receiving space 20 of the container 11 so as to be disposed substantially adjacent the closed lower end 14 of the container 11 (FIGS. 6 and 7) as will be described in more detail herein after; or the tuft of material 26 can be connected to a flexible substrate 28*a* supported within the object receiving space 20 of the container 11 so as to be disposed substantially adjacent the closed lower end 14 of the container 11 (FIGS. 8 and 9). Thus, the tuft of material 26, in addition to being bonded to the flexible, inflatable substrate assembly 28, may be bonded to the flexible substrate 28*a* (FIGS. 8 and 9), and the tuft of material 26 may also be bonded to at least a portion of the inner surface 16 of the container 11 which surrounds the object receiving space 20 of the container 11.

Referring again to FIGS. 1 and 2, the packaging material 23 is illustrated as the tuft of material 26 and the tuft of material 26 is illustrated as being disposed within at least a portion of the object receiving space 20 of the container 11 and secured therein by bonding at least a portion of the tuft of material 26 to at least a portion of the closed lower end 14 and/or the inner surface 16 of the container 11. If desired, the strips or strands of material 24 which constitutes the tuft of material 26 can be intertwined and bonded together by applying a bonding material to at least a portion of the individual strips or strands of material 24 and/or at least a portion of the closed lower end 14 of the container 10 and/or the inner surface 16 of the container 11.

In FIG. 1 the container 11 is depicted in an erect condition and the tuft of material 26 fills a substantial portion of the object receiving space 20 of the container 11. As previously discussed, the tuft of material 26 is bondingly connected to at least a portion of the closed lower end 14 and/or the inner surface 16 of the container 11 so that when the container 11 is moved to a collapsed condition as shown in FIG. 2, the tuft of material 26 is compressed and remains in the object receiving space 20 of the collapsed container 11.

The individual strips or strands of material 24 utilized to produce the tuft of material 26 can be fabricated from any flexible material including, but not limited to, paper, crape paper, polymeric film, wax paper, laminates and combinations thereof. For example, at least one clear layer of polymeric material can be laminated to at least one iridescent layer of polymeric film so as to provide an iridescent effect to the laminated polymeric film, and thus the individual strips or strands of material 24 produced from the sheet of laminated material. In addition, the flexible material from which the individual strips or strands of material 24 are fabricated may have printed material and/or one or more embossed patterns on at least a portion of at least one side thereof, and the one or more embossed patterns may be in register or out of register with the printed material and/or each other.

The plurality of individual strips or strands of material 24 may also be fabricated from organic or inorganic materials, including leaves, tree bark, branches, dirt, sand, sea shells, Spanish moss or any other type of organic or inorganic material that is capable of forming the tuft of material 26 and/or capable of being bondingly connected to at least one of the closed lower end 14 and/or the inner surface 16 of the container 11 and/or the flexible inflatable substrate assembly 28 or the flexible substrate 28*a* supportable on the closed lower end 14 of the container 11 such that the tuft of material 26 is disposed in the object receiving space 20 of the container 10 and thereby provides a decorative and/or cushioning effect for objects supported within the object receiving space 20 of the container 11. Furthermore, when the strips or strands of material 24 are fabricated from a flexible material, additional inorganic and/or organic materials may be attached onto or be incorporated into the strips or strands of material 24 prior to or after forming the tuft of material 26 from the strips or strands of material 24.

As previous stated, at least a portion of at least one side of the strips or strands of the material 24 can be provided with printed material thereon. The printed material on the flexible material from which the individual strips or strands of material 24 are fabricated can be printed in a conventional manner so that when the flexible material is slit and cut to produce the strips or strands of material 24 at least a portion of the strips or strands of material 24 contain at least a portion of the printed material. Further, different colors can be employed to provide the printed material on the sheet of material from which the plurality of individual strips or strands of material 24 are fabricated.

Also, the flexible material employed to produce the strips or strands of material 24 may include one or more embossed patterns which are provided on the flexible material prior to slitting and cutting the sheet of material to provide the strips or strands of material 24. Further, the flexible material can be provided with an embossed pattern as well as a printed pattern, and the embossed pattern may be either in register or out of register with the printed material, which may be in the form of writing, a design, or any other style of printing depicting any message that the user desires.

The individual strips or strands of material 24, as described above, are commonly referred to as "Easter grass" or "decorative grass" and such have been used for many years in filling fruit baskets, Easter baskets, picnic baskets, and for other decorative and packaging purposes. The decorative grass of the prior art has been produced by numerous methods and from a variety of materials, such as those listed above. Typically, such materials are shredded and cut to produce segmented strips having predetermined dimensions. While the prior art methods for making the decorative grass have been widely accepted, new techniques for facilitating the use of decorative grass as a packaging material have been sought in view of the fact that decorative grass and other loose shredded packaging material of the prior art readily fall onto the floor, cling to various objects making them awkward and inconvenient to clean up, and often compact and thereby no longer adequately cushion and/or protect items placed thereon.

By forming the strips or strands of material 24 into the tuft of material 26 (which is composed of a plurality of the strips or strands of material 24) and connecting the tuft of material 26 to the closed lower end 14 and/or the interior surface 16 of the container 11 as herein before described with reference FIGS. 1 and 2, or by connecting the tuft of material 26 to the flexible inflatable substrate assembly 28 or the flexible substrate 28*a* as will be described in more detail herein after, clean up problems associated with loose fill materials are alleviated and the container 11 containing the tuft of material 26 can be selectively moved between the erect condition as shown in FIG. 1 and the collapsed condition as shown in FIG. 2 without the strips or strands of material 24 forming the tuft of material 26 falling from the object receiving space 20 of the container 11.

Figure 5:
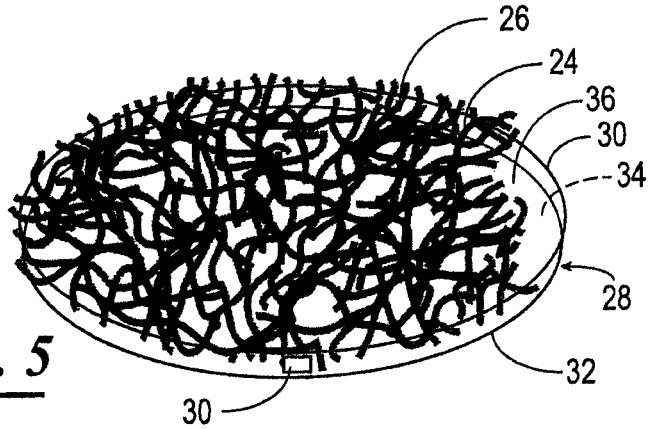
FIG. 5 is a perspective view of a flexible inflatable substrate assembly in an inflated condition, the flexible inflatable substrate assembly cooperating with containers selectively movable between an erect condition and a collapsed to construct a container assembly in accordance with the presently disclosed and claimed inventive concept(s).

Referring now to FIG. 5, shown therein is a packaging material which includes the flexible inflatable substrate assembly 28 having the tuft of material 26 formed of a plurality of individual strips or strands of material 24 bondingly connected thereto. As can be appreciated, by connecting the tuft of material 26 to the flexible inflatable substrate assembly 28, not only is the problem associated with the clean-up of loose fill material alleviated, but since the flexible inflatable substrate assembly 28 is capable of being inflated, the compacting problems associated with loose fill material are also alleviated and lesser amounts of fill material are required. The flexible inflatable substrate assembly 28 can also be caused to adhere or cohere to an object and/or the container 11 in which it is placed thereby resulting in an attached packaging effect. That is, with loose fill packaging material the object being packed has a tendency to gravitate through the packaging material to the bottom of the container thereby reducing the effectiveness of the packaging material. By using the flexible inflatable substrate assembly 28 disclosed herein, the cohesiveness of the tuft of material 26 and the flexible inflatable substrate assembly 28 retard the object supported thereon from gravitating through the container 11 towards the closed lower end 14 of the container 11.

The flexible inflatable substrate assembly 28 for use in the presently disclosed and claimed inventive concept(s) is fabricated of a first sheet of material 30 and second of material 32. It will be appreciated that the dimensions of the flexible inflatable substrate assembly 28 may be varied and the shape of the flexible inflatable substrate assembly 28 may also, therefore, be varied—e.g., a circle, square, triangle, heart, and animal shape, a floral shape, etc.

The flexible inflatable substrate assembly 28 which can be employed as a packaging material in accordance with the presently disclosed and claimed inventive concept(s) can be fabricated of any flexible material capable of retaining a fluid, such as air, in an inflatable chamber 34 formed by the union of the first and second sheets of the material 30 and 32, respectively. Examples of materials capable of being employed to form the flexible inflatable substrate assembly 28 include, but are not limited to, polymeric materials, laminated polymeric materials, fabrics having a fluid impervious coating, foil and alike.

The flexible inflatable substrate assembly 28 which can be employed as a packaging material in accordance with the presently disclosed and claimed inventive concept(s) may also have printed material 37 (FIG. 7) and/or one or more embossed patterns 38 on at least a portion of at least one of first sheet of material 30 and the second sheet of material 32, and the one or more embossed patterns 38 can be in register or out of register, or partially in register and partially out of register with the printed material 36. In addition, different colors can be employed to provide the printed material or pattern on at least one of the first or second sheets of material 30 and/or and 32, such as the first sheet of material 30, so that when the flexible inflatable substrate assembly 28 is positioned within the object receiving space 20 of the container 11 substantially adjacent the closed lower end 14 thereof, the printed and/or embossed patterns are visible.

It should be noted the printed material 37 may be a pictorial representation with the color or shape of the tuft of material 26 formed of a plurality of the strips or strands of material 24 so that when a small amount of the plurality of individual strips or strands 24 are employed to form the tuft of material 26, and the tuft of material 26 is bondingly connected to the first sheet of the material 30 of the flexible inflatable substrate assembly 28, the printed material fills in the voids between the plurality of individual strips or strands of materials 24 such that it appears that there are few or no actual voids in the tuft of material 26 formed from the plurality of strips or strands of material 24 thereby resulting in an aesthetically pleasing flexible inflatable substrate assembly 28. Alternatively, at least one surface of the flexible inflatable substrate assembly 28, such as an upper surface 36 of the first sheet of the material 30, can be printed so as to give the appearance of the presence of the tuft of material 26 without the tuft of material 26 being formed from a plurality of strips or strands of material 24.

The first sheet of material 30 and the second sheet of material 32 of the flexible inflatable substrate assembly 28 may be constructed of a single layer of material or a plurality of layers of the same or different types of material. In addition, the thickness of the first sheet of material 30 and the second sheet of material 32 of the flexible inflatable substrate assembly 28 may vary widely, the only requirement being that the first and second sheets of material 30 and 32, respectively, have sufficient structural integrity to support objects placed thereon without the weight of the objects causing damage to the flexible inflatable substrate assembly 28.

The first sheet of material 30 is bonded via a bonding material (not shown) to the second sheet of material 32 so as to provide the inflatable chamber 34 of the flexible inflatable substrate assembly 28. The flexible inflatable substrate assembly 28 is further provided with a valve 39 which is in fluid communication with the inflatable chamber 34 and thus provides a conventional method of injecting a gas, such as air, into the inflatable chamber 34 of the flexible inflatable substrate assembly 28 so as to inflate the flexible inflatable substrate assembly 28.

Any type of valve capable of introducing a gas, such as air, into the inflatable chamber 34 of the flexible inflatable substrate assembly 28 can be employed as the valve 39 in the practice of the presently disclosed and claimed inventive concept(s), provided that the valve closes off the inflatable chamber 34 once the inflatable chamber 34 has been inflated. Such valves are well known in the art. Thus, any conventional valve capable of performing the functions described above can be employed as the valve 39 of the flexible inflatable substrate assembly 28.

In place of the valve 39, one may inflate the flexible inflatable substrate assembly 28 utilizing an exothermic reaction which produces a gas capable of filling at least a portion of the inflatable chamber 34 of the flexible inflatable assembly 28. In order to provide an exothermic reaction, the inflatable chamber 34 of the flexible inflatable substrate assembly 28 may be provided with at least two chambers where at least one chamber contains a weak basic composition and at least one chamber contains a weak acid composition such that, upon breaking open the at least one chamber containing the weak acid composition and the at least one chamber containing the weak basic composition, a reaction occurs which forms a gaseous reaction product that substantially fills the inflatable chamber 34 of the flexible inflatable substrate assembly 28. The weak basic composition may include a Group I or a Group II element and examples of such weak basic compositions include sodium carbonate, calcium carbonate, and combinations thereof. The weak acid composition may be vinegar. Although certain compositions have been disclosed as being capable of producing an exothermic reaction, any combination of composition that, when placed in reactive contact with one another, produces a gaseous reaction product that fills the inflatable chamber 34 of the flexible inflatable substrate assembly 28 can be employed provided that the compositions are not deleterious to the first and second sheets of material 30 and 32 from which the flexible inflatable substrate assembly 28 is constructed.

Although the flexible inflatable substrate assembly 28 is shown in FIG. 5 as having a circular configuration, is to be understood that the flexible inflatable substrate assembly 28 can be of any shape and the particular shape will be depended on the configuration of the closed lower end 14 of the container 11. For example, if the closed lower end 14 of the container 11 has a square configuration, the configuration of the flexible inflatable substrate assembly 28 will desirably also be square. On the other hand, if the closed lower end 14 of the container 11 has a rectangular configuration then the configuration of the flexible inflatable substrate assembly 28 will desirably also be rectangular.

Figure 6:
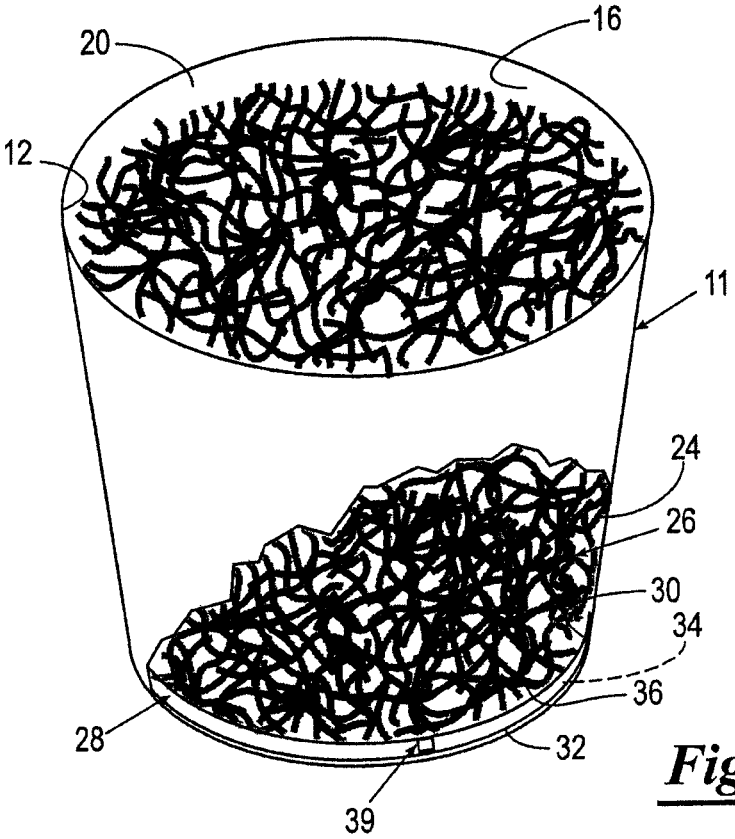
FIG. 6 is a partially cut-away, perspective view of the container of FIG. 3 having the flexible inflatable substrate assembly of FIG. 5 disposed therein, the flexible inflatable substrate assembly having a plurality of strands or strips of material disposed thereon.

To secure the tuft of material 26 to an exterior surface of the flexible inflatable substrate assembly 28, such as the upper surface 36 of the first sheet of material 30, at least a portion of the upper surface 36 of the first sheet of material 30 of the flexible inflatable substrate assembly 28 is coated with a bonding material, such as an adhesive or cohesive bonding material, whereby the tuft of material 26 is bonded to the upper surface of the first sheet of material 30 of the flexible inflatable substrate assembly 28 substantially as shown in FIGS. 5 and 6. As previously stated, the tuft of material 26 is formed of a plurality of strips or strands of material 24 which are intertwined and desirably bonded together. The strips or strands of material 24 employed in the formation of the tuft of material 26 are well known and can be produced by slitting a web of material and thereafter cutting the slit web of material to provide strips or strands of material having desired dimensions. The bonding material can be applied to the strips or strands of material 24 either prior to cutting the slit web of material to produce the strips or strands of material 34 or after such strips or strands of material 24 had been produced. As an alternative to forming the individual strips or strands of material 24 as described herein before, it will be appreciated that the individual strips or strands of material 24 may be formed from a polymeric film discharged from a film extrusion die which is then chilled prior to the slitting process. Such a method is disclosed in U.S. Pat. No. 4,292,266, entitled "Process For Making Decorative Grass", issued to Weder et al. on Sep. 29, 1981, the entire contents of which is hereby expressly incorporated herein by reference.

Referring now to FIG. 6 in combination with FIG. 5, the flexible inflatable substrate assembly 28 shown in FIG. 5 is positioned adjacent the closed lower end 14 of the container 11 substantially as shown in FIG. 6. Thereafter, additional quantities of the tuft of material 26 formed from the strips or strands of material 24 are positioned on the flexible inflatable substrate assembly 28. By intertwining the strips or strands of material 24 during the formation of the tuft of material 26, in combination with the adhering of the tuft of material 26 to an exterior surface, such as the upper surface 36 of the first sheet of material 30 of the flexible inflatable substrate assembly 28, the additional tuft of material 26 is secured and stabilized within the object receiving space 20 of the container 11. If desired, and to further enhance stabilization of the tuft of material 26 within the object receiving space 20 of the container 11, at least a portion of the inner surface 16 of the container 11 can be coated with a suitable bonding of material such that the tuft of material 26 is bondingly connected, not only to the flexible inflatable substrate assembly 28, but also to the inner surface 16 of the container 10. As previously stated, each of the individual strips or strands of material 24 can also be coated with a bonding material to enhance cohesion of the strips or strands of material 24 during formation of the tuft of material 26.

Figure 7:
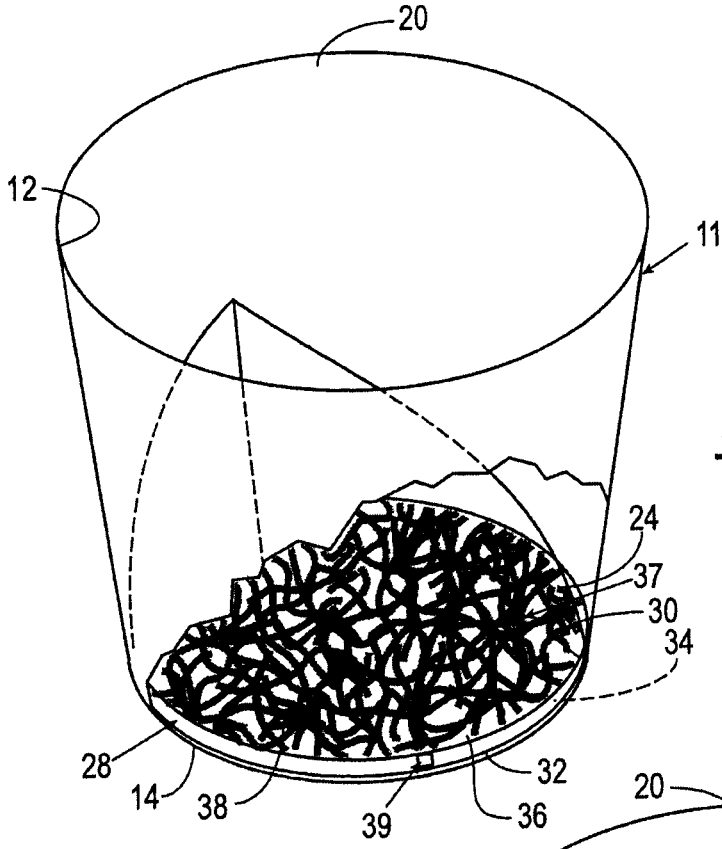
FIG. 7 is a partially cut-away, perspective view of a container assembly constructed in accordance with the presently disclosed and claimed inventive concept(s) which includes the contain of FIG. 3 and a flexible inflatable substrate assembly wherein the flexible inflatable substrate assembly is in an inflated condition and an upper surface of the flexible inflatable substrate assembly has a pattern printed thereon to simulate a tuft of material formed of a plurality of strands of material.

Referring now to FIG. 7, the flexible inflatable substrate assembly 28 is provided with a printed pattern 39 representing a plurality strips or strands of material on at least one surface thereof, such as the upper surface 36 of the first sheet of material 30 of the flexible inflatable substrate assembly 28. Desirably, the flexible inflatable substrate assembly 28 is bondingly connected to the closed lower end 14 of the container 11 to ensure its stability therein. However, it should be understood that the flexible inflatable substrate assembly 28 can be disposed within the object receiving space 20 of the container 11 so as to be disposed adjacent the closed lower end 14 of the container 11 and supported therein without the use of any bonding material.

The above embodiments of the flexible inflatable substrate assembly 28, as well as other embodiments of flexible inflatable substrate assemblies which may be employed in the practice of the presently disclosed and claimed inventive concept(s) are disclosed in copending U.S. patent application Ser. No. 11/063,024 entitled Flexible Packaging Materials And Methods Of Making A Using Same, filed Feb. 22, 2005, the entire contents of such application being hereby specifically incorporated herein by reference.

Referring now to FIG. 8, shown therein is a flexible substrate 28*a* disposed within the container 11 such that the flexible substrate 28*a* is positioned substantially adjacent the closed lower end 14 of the container 11 substantially as shown. The flexible substrate 28*a* may be provided with a printed pattern 42 on an upper surface 44 thereof which may be a pictorial representation of a tuft of material formed of a plurality of strips or strands of material such as the tuft of material 26 formed of a plurality of the strips or strands of material 24 herein before described. If desired, in addition to the printed pattern 42, a tuft of material 26*a* may be bondingly connected to the upper surface 44 of the flexible substrate 28*a* whereby the printed pattern 42 fills the voids between the plurality of individual strips or strands of material 24*a* employed to form the tuft of material 26*a* such that it appears that there are few or no actual voids in the tuft of material 26*a* thereby resulting in an aesthetically pleasing flexible substrate 28*a* (FIG. 9). It should be noted that the flexible substrate 28*a* can be employed in the practice of the presently disclosed and claimed inventive concept(s) where only the upper surface 42 of the flexible substrate 28*a* is provided with the printed pattern 44 to give the appearance of a tuft of material without the tuft of material being present (FIG. 7); or the tuft of material 26 can be bondingly connected to the upper surface 42 of the flexible substrate 28*a* as hereinbefore described.

Referring now to FIG. 9, the flexible substrate 28*a* is shown as having a tuft of material 26*a* bondingly connected thereto wherein the tuft of material 26*a* is formed of a plurality of individual strips or strands of material similar to the strips or strands of material 24 herein before described. As can be appreciated, by connecting the tuft of material 26*a* to the flexible substrate 28*a*, not only is the problem associated with the clean-up of loose fill material alleviated, but the tuft of material 26*a* reduces the tendency of the object being packaged within the container 11 from gravitating through the tuft of material 26*a* to the closed lower end 14 of the container 11. Further, since the flexible substrate 28*a* is disposed substantially adjacent the closed lower end 14 of the container 11, the container 11 can be selectively moved to the collapsed or substantially flattened condition whereby the tuft of material remains within the object receiving space 20 of the container 11 in the same manner as has been herein before described with reference to FIG. 2. It should also be noted that the tuft of material 26*a* can also be bondingly connected to the interior surface 16 of the container 11 and/or the flexible substrate 28*a* can be bondingly connected to the closed lower end 14 of the container 11 to ensure stabilization of the tuft of material 26*a* within the object receiving space 20 of the container 11 when the container 11 is in either the erect condition as shown in FIG. 1, or the collapsed condition as shown in FIG. 2.

The flexible substrate 28*a* can be fabricated with any material which has sufficient flexibility to permit the container 11 to be selectively moved to the collapsed or flattened condition, while at the same time having sufficient structural integrity to permit either the printing of the printed pattern 42 on the upper surface 44 thereof or to permit the tuft of material 26*a* to be bondingly connected to the upper surface 44 of the flexible substrate 28*a*. Typical materials which may be employed in the construction of the flexible substrate 28*a* are polymeric film, paper, cardboard, laminations thereof or any other material capable of functioning in the matter herein described.

Figure 10:
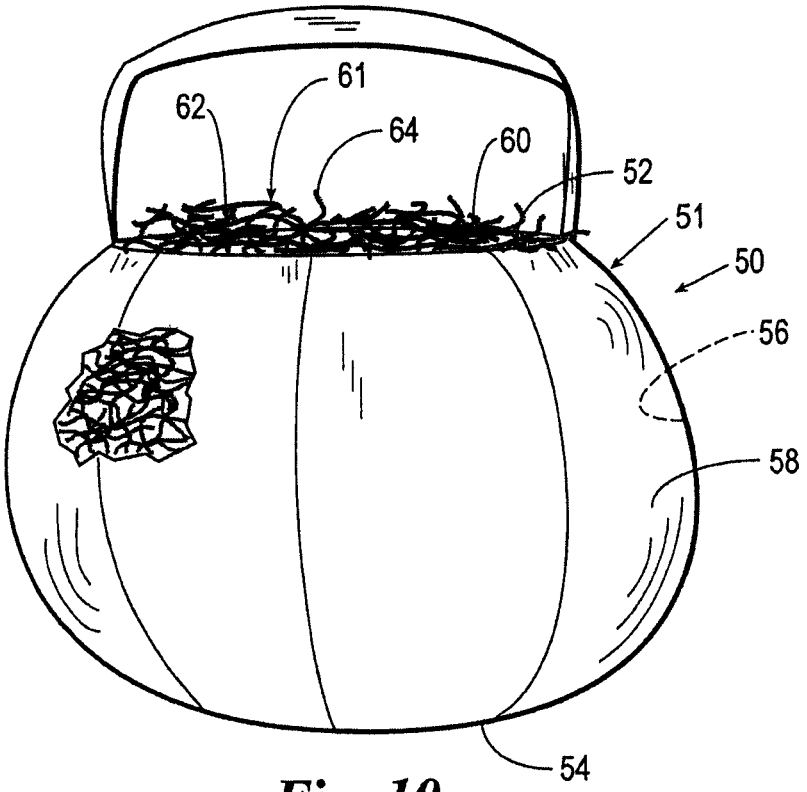
FIG. 10 is a partially cut-away perspective view of a container assembly constructed in accordance with the presently disclosed and claimed inventive concept(s) wherein a container is in an erect condition and a tuft of material is disposed therein.

Referring now to FIG. 10, shown therein is another embodiment of a container assembly 50 constructed in accordance with the presently disclosed and claimed inventive concept(s). The container assembly 50 is provided with a collapsible and/or erectable container 51 which is disposed in an erect condition in FIG. 10 and a collapsible or substantially flattened condition in FIG. 11. The container 51 includes an open upper end 52, a closed lower end 54, an inner surface 56, an outer surface 58, and an object receiving space 60.

A packaging material 61 (i.e., a tuft of material 62 formed of a plurality of individual strips or strands of material 64, such as the individual strips or strands 24 herein before described and which may be intertwined with one another), is disposed within the object receiving space 60 of the container 51 for cushioning objects disposed within the object receiving space 60 of the container 51. The tuft of material 62 can be connected to at least a portion of the inner surface 56 of the container 51 so that the tuft of material 62 extends from the closed lower end 54 of the container 51 towards the open upper end 52 thereof; or the tuft of material 62 can be connected to a flexible, inflatable substrate assembly such as the flexible, inflatable substrate assembly 28 herein before described; or to a flexible substrate 28*a* as also herein before described.

When employing a flexible, inflatable substrate assembly or a flexible substrate in combination with the container 51, the flexible inflatable substrate assembly or the flexible substrate are supported within the object receiving space 60 of the container 51 in the same manner as herein before described with reference to the container 11. When employing a flexible inflatable substrate assembly or a flexible substrate in combination with the tuft of material 62, the tuft of material 62 may be bondingly connected to the flexible inflatable substrate assembly or the flexible substrate as herein before described, and the tuft of material 62 may also be bonded to at least a portion of the inner surface 56 of the container 51 which surrounds the object receiving space 60 of the container 51.

As previously stated, the strips or strands of material 64 constituting the tuft of material 62 can be intertwined and bonded together by applying a bonding material to at least a portion of the closed lower end 54 and/or the inner surface 56 of the container 51. Further, the strips or strands of material 64 which constitutes the tuft of material 62 can be formed into a mass of the tuft of material 62 by employing a combination of a bonding material and the mere intertwining of the strips or strands of material 64 constituting the tuft of material 62.

As shown in FIG. 10, the container 51 can be selectively disposed in a collapsed or substantially flattened condition. When the container 51 is in the collapsed or substantially flattened condition, the tuft of material 62 remains within the object receiving space 60 of the container 51 in the same manner herein before described with reference to the container 11.

Figure 11:
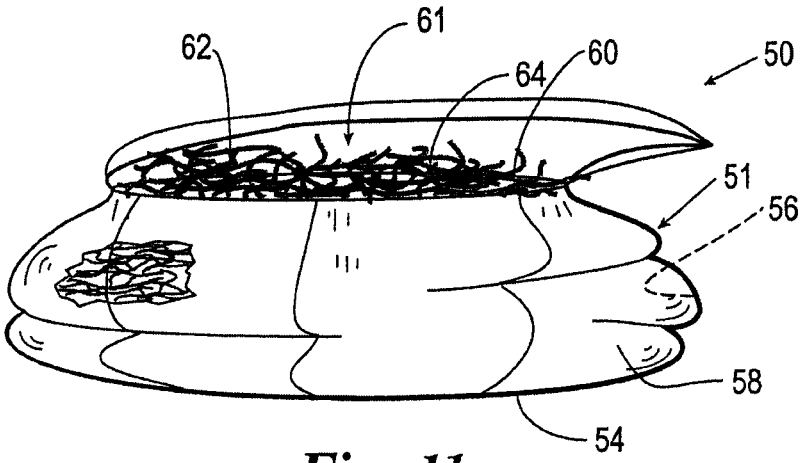
FIG. 11 is a partially cut-away perspective view of the container assembly of FIG. 10 wherein the container is in a partially collapsed condition and has the tuft of material supported therein.
Figure 12:
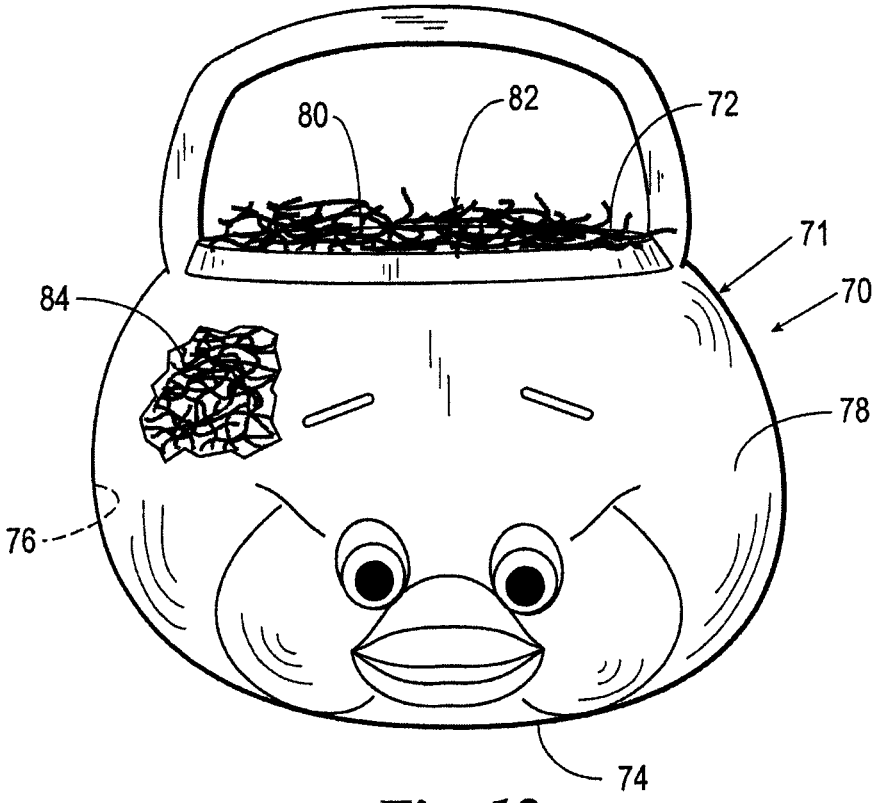
FIG. 12 is a partially cut-away perspective view of a container assembly wherein a container is in an erect condition and a tuft of material is supported therein.
Figure 13:
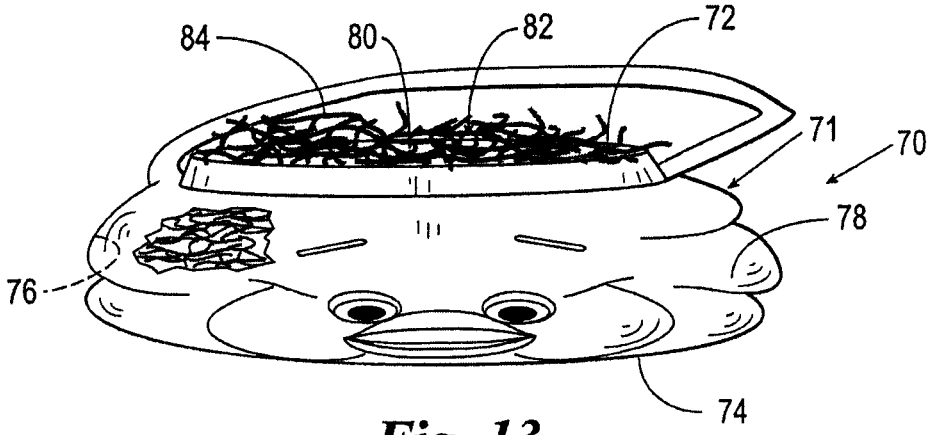
FIG. 13 is a partially cut-away perspective view of the container assembly of FIG. 12 wherein the container is in a partially collapsed condition and has the tuft of material supported therein.

Referring now to FIG. 11, another embodiment of a container assembly 70 for use in the practice in the presently disclosed and claimed inventive concept(s) is shown. The container assembly 70 is provided with an inflatable container 71 which can be selectively inflated to an erect condition (as shown in FIG. 12) or deflated so as to be disposed in a collapsed or substantially flattened condition (as shown in FIG. 13). The container 71 is provided with an open upper end 72, a closed lower end 74, an inner surface 76, an outer surface 78, and an object receiving space 80.

A tuft of material 82 is formed of a plurality of individual strips or strands of material 84, such as the individual strips or strands of material 24 herein before described, which may be intertwined with one another and which can be supported within the object receiving space 80 of the container 71 for cushioning objects disposed within the object receiving space 80 of the container 71 when the container 71 is in an inflated or erect condition. The tuft of material 82 can be connected to at least a portion of the inner surface 76 of the container 71 so that the tuft of material 82 extends from the closed lower end 74 of the container 71 towards the open upper end 72 thereof; or the tuft of material 82 can be connected to a flexible, inflatable substrate such as the flexible inflatable substrate 24 herein before described or to a flexible substrate such as the flexible substrate 28*a* as also herein before described.

When employing a flexible inflatable substrate assembly or a flexible substrate in combination with the container 71, the flexible inflatable substrate assembly or the flexible substrate are supported within the object opening 80 of the container 71 in the same manner is herein before described with reference to the container 11. When employing a flexible inflatable substrate assembly or a flexible substrate in combination with the tuft of materials 82, the tuft of material 82 can be bondingly connected to the flexible inflatable substrate assembly or the flexible substrate as hereinbefore described, and the tuft of material may also be bonded to at least a portion of the inner surface 76 which surrounds the object receiving space 80 of the container 71.

The strips or strands of material 84 constituting the tuft of material 82 can be intertwined and bonded together by applying a bonding material to at least a portion of the closed lower end 74 and/or the inner surface 76 of the container 71. Further, the strips or strands of material 84 which constitutes the tuft of material 82 can be formed into a mass of the tuft of material 82 by employing a combination of bonding material and the mere intertwining of the strips or strands of material constituting the tuft of material 82. As shown in FIG. 13, when the container is selectively disposed in a substantially collapsed, flattened, or deflated condition, the tuft of material 82 remains within the object receiving space 80 of the container 71 in the same manner hereinbefore described with reference to the container 11. Lastly, it is to be understood that the container 71 can be provided with a pictorial decoration on the outer surface 78 thereof, such as, for example, a pictorial representation of a chicken.

From the above description, it is clear that the presently disclosed and claimed inventive concept(s) is well adapted to carry out the objects and to attain the advantages mentioned herein as well as those inherent in the presently disclosed and claimed inventive concept(s). While certain embodiments of the inventive concept(s) have been described for purposes of this disclosure, it will be understood that numerous changes may be made which will readily suggest themselves to those skilled in the art and which are accomplished within the spirit of the inventive concept(s) disclosed and claimed.

What is claimed is:

1. A method of packaging an item, comprising the steps of:

providing a container assembly in a substantially collapsed condition, the container assembly comprising:

a decorative shape sustaining container having an open upper end, a closed lower end, an inner surface, an outer surface and an object receiving space, the decorative shape sustaining container selectively movable between the substantially collapsed condition and an erect condition; and a packaging material disposed within the object receiving space of the decorative shape sustaining container for cushioning objects supported in the object receiving space of the decorative shape sustaining container, at least a portion of the packaging material connected to at least a portion of at least one of the inner surface and the closed lower end so that the packaging material remains substantially within the object receiving space of the decorative shape sustaining container when the decorative shape sustaining container is in the partially collapsed condition;

opening the container assembly to the erect condition; and disposing an item on the packaging material disposed within the object receiving space of the decorative shape sustaining container, and wherein the decorative shape sustaining container remains in the erected, shape sustaining condition while the item is disposed within the object receiving space thereof.

2. The method of claim 1 wherein, in the step of providing a container assembly, the packaging material comprises a tuft of material formed of a plurality of intertwined strips of material.

3. The method of claim 1 wherein, in the step of providing a container assembly, at least a portion of the intertwined strips of the packaging material are bonded together.

4. The method of claim 1 wherein, in the step of providing a container assembly, the decorative shape sustaining container is provided with a gusset to enhance movement of the decorative shape sustaining container between the collapsed condition and the erect condition.

5. The method of claim 1 wherein, in the step of providing a container assembly, the packaging material is a flexible support member disposable adjacent at least a portion of the closed lower end of the decorative shape sustaining container, the flexible support member having a printed pattern disposed on at least a portion thereof so as to provide the flexible support member with an appearance simulating the appearance of grass.

6. The method of claim 5, wherein the flexible support member further includes an embossed pattern on at least a portion thereof.

7. The method of claim 6, wherein the embossed pattern is in register with the printed pattern.

8. The method of claim 6, wherein the embossed pattern is out of register with the printed pattern.

9. The method of claim 5, wherein the packaging material further includes a tuft of material connected to at least a portion of the upper surface of the flexible support member.

10. The method of claim 9, wherein the printed pattern is provided on at least a portion of the upper surface of the flexible support member and the printed pattern simulates the appearance of decorative grass.

11. The method of claim 1 wherein, in the step of providing a container assembly, the packaging material comprises an inflatable support member disposable adjacent at least a portion of the closed lower end of the decorative shape sustaining container.

12. The method of claim 11, wherein the inflatable support member is provided with a printed pattern disposed on at least a portion thereof to provide the inflatable support member with an appearance that simulates the appearance of grass.

13. The method of claim 12, wherein the inflatable support member further includes an embossed pattern on at least a portion thereof.

14. The method of claim 13, wherein the printed pattern is in register with the embossed pattern.

15. The method of claim 13, wherein the printed pattern is out of register with the embossed pattern.

16. The method of claim 15, wherein the packaging material further includes a mass of at least one of individual strips of material, individual strands of material and individual units of material connected to the inflatable support member.

17. The method of claim 16, wherein an upper surface of the inflatable support member is provided with a printed pattern thereon simulating the appearance of the mass of at least one of individual strips of material, individual strands of material and individual units of material connected thereto.

18. The method of claim 17, wherein the packaging material further includes a bonding material disposed on at least a portion of the mass of at least one of individual strips of material, individual strands of material and individual units of material to form a cohesive mass of at least one of individual strips of material, individual strands of material and individual units of material connected to the inflatable substrate.

19. The method of claim 18, wherein the at least one of individual strips of material, individual strands of material and individual units of material are intertwined to form a cohesive mass of at least one of individual strips of material, individual strands of material and individual units of material and wherein at least a portion of the cohesive mass of at least one of individual strips of material, individual strands of material and individual units of material are connected to the inflatable support member.

20. The method of claim 1 wherein, in the step of providing a container assembly, the decorative shape sustaining container is further defined as a decorative basket.

* * * * *